US011280153B2

(12) United States Patent
Kobayashi et al.

(10) Patent No.: US 11,280,153 B2
(45) Date of Patent: Mar. 22, 2022

(54) PLUG, RETAINING MEMBER, AND METHOD FOR WELL COMPLETION USING PLUG

(71) Applicant: Kureha Corporation, Tokyo (JP)

(72) Inventors: Seishiro Kobayashi, Tokyo (JP); Teruaki Yoshii, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

(21) Appl. No.: 16/615,950

(22) PCT Filed: Jul. 9, 2018

(86) PCT No.: PCT/JP2018/025902
§ 371 (c)(1),
(2) Date: Nov. 22, 2019

(87) PCT Pub. No.: WO2019/031134
PCT Pub. Date: Feb. 14, 2019

(65) Prior Publication Data

US 2020/0190935 A1 Jun. 18, 2020

(30) Foreign Application Priority Data

Aug. 10, 2017 (JP) ..... JP2017-156158

(51) Int. Cl.
*E21B 33/12* (2006.01)

(52) U.S. Cl.
CPC ..... *E21B 33/1216* (2013.01)

(58) Field of Classification Search
CPC ..... E21B 33/128; E21B 33/1216; E21B 33/1285; E21B 33/129; E21B 33/1291;
(Continued)

(56) References Cited

U.S. PATENT DOCUMENTS 3,389,917 A * 6/1968 McGill ..... E21B 33/126 277/335
4,765,404 A 8/1988 Bailey et al.
(Continued)

FOREIGN PATENT DOCUMENTS

| | | | |
|---|---|---|---|
| CN | 106661924 | A | 5/2017 |
| JP | S60-1 00490 | U | 7/1985 |
| JP | H01-001892 | A | 1/1989 |
| JP | 2013-245444 | A | 12/2013 |
| WO | 2017/111159 | A1 | 6/2017 |

OTHER PUBLICATIONS

International Search Report of International Application No. PCT/JP2018/025902 dated Jul. 31, 2018 [English Translation Attached].
(Continued)

*Primary Examiner* — David Carroll
(74) *Attorney, Agent, or Firm* — Birch, Stewart, Kolasch & Birch, LLP

(57) ABSTRACT

A plug which does not cause an adverse effect such as failure of a member constituting the plug when a wellbore is plugged. The downhole plug (10) includes a mandrel (1) having a hollow structure, a sealing member (2) attached to an outer circumferential surface of the mandrel (1) and being deformable by exerted pressure, and a socket (3) attached, adjacent to the sealing member (2), onto the outer circumferential surface of the mandrel (1), downstream of where the pressure is exerted on the sealing member (2). An inner circumferential edge (31*a*) of the socket (3) which comes in contact with the mandrel (1) protrudes toward the sealing member (2).

8 Claims, 12 Drawing Sheets

(58) Field of Classification Search
CPC ..... E21B 33/1292; E21B 33/1293; E21B 33/1295; E21B 33/12955
See application file for complete search history.

(56) References Cited

U.S. PATENT DOCUMENTS

| | | | | |
|---|---|---|---|---|
| 2008/0060821 | A1* | 3/2008 | Smith | E21B 33/1216 166/387 |
| 2011/0259610 | A1 | 10/2011 | Shkurti et al. | |
| 2011/0277989 | A1 | 11/2011 | Frazier | |
| 2013/0240203 | A1* | 9/2013 | Frazier | E21B 33/134 166/193 |
| 2017/0234075 | A1 | 8/2017 | Nakamura | |
| 2019/0017346 | A1 | 1/2019 | Kobayashi et al. | |

OTHER PUBLICATIONS

International Preliminary Report on Patentability and Written Opinion dated Feb. 20, 2020, in PCT/JP2018/025902 (Forms PCT/IB/338, PCT/IB/373, and PCT/ISA/237).
Canadian Office Action for Canadian Application No. 3,063,836, dated Feb. 18, 2021.
Office Action for CN Application No. 201880029979.1, dated Apr. 6, 2021.
Canadian Office Action and Search Report for Canadian Application No. 3,063,836, dated Sep. 15, 2021.
Chinese Office Action and Search Report for Chinese Application No. 201880029979.1 dated Oct. 15, 2021, with English translation.

* cited by examiner

PLUG, RETAINING MEMBER, AND METHOD FOR WELL COMPLETION USING PLUG

TECHNICAL FIELD

The present invention relates to a plug and a retaining member used for well completion, and a method for well completion using the plug.

BACKGROUND ART

Various tools have been developed which are referred to as downhole tools for plugging and fixing a wellbore for excavating shale oil by hydraulic fracturing or the like. As one of these downhole tools, downhole plugs are known. One of the functions of the downhole plug is that a prescribed member constituting the downhole plug abuts against an inner wall of a wellbore to fix the downhole plug to the wellbore, and the wellbore is blocked by an elastic member or the like constituting the downhole plug (for example, Patent Document 1).

CITATION LIST

Patent Document

Patent Document 1: US 2011/0,277,989 A (published on Nov. 17, 2011)

SUMMARY OF INVENTION

Technical Problem

In the case of a downhole tool with which a wellbore is plugged by an elastic member, supposing that deformation of the elastic member is not controlled, a desired advantage cannot be obtained due to an unanticipated deformation of the elastic member, where, in the worst case, an issue arises in that damage is caused to other components constituting the downhole plug. This issue will be described below in detail with reference to FIGS. 10 and 11.

FIGS. 10 and 11A and 11B are explanatory reference views illustrating an issue in downhole plugs in the related art. FIG. 10 is a view schematically illustrating a portion of an axial cross-section of a downhole plug in the related art. FIGS. 11A and 11B is a view illustrating a portion of the downhole plug illustrated in FIG. 10. Note that, for convenience of explanation, in FIGS. 10 and 11A and 11B, an axial direction of the downhole plug is illustrated as the horizontal direction of the plane of the paper. In an actual use, however, the downhole plug is occasionally disposed such that the axial direction of the downhole plug extends along the depth direction of a wellbore. In addition, in FIGS. 11A and 11B, shapes of some members illustrated in FIG. 10 are illustrated in a simplified manner.

First, as illustrated in FIG. 10, a downhole plug 100 includes a mandrel 101, an elastic member 102, a retaining member 103 disposed adjacent to the elastic member 102 on one side of the elastic member 102, cones 104 and 105 disposed in a manner to clamp the elastic member 102 and the retaining member 103, a pair of slips 106*a* and 106*b*, and a pair of ring members 107*a* and 107*b*.

In a wellbore (not illustrated), the downhole plug 100 is installed within a casing 20 disposed inside the wellbore as illustrated in FIG. 11A. When the wellbore is plugged by the downhole plug 100, the elastic member 102 is deformed as a gap between the cone 105 and the retaining member 103 is narrowed due to an axial movement of the mandrel 101. Then, the elastic member 102 expands radially outward in a circumferential direction of a shaft of the mandrel 101. Then, the elastic member 102 abuts against the casing 20, to thus cause between the downhole plug 100 and the casing 20 to be plugged. Subsequently, the wellbore is plugged by setting a ball or the like (not illustrated) at a hollow portion in an axial direction of the mandrel 101. A fluid is then pumped at high pressure into the plugged section from the cone 105 side, to perform hydraulic fracturing for forming fractures in a productive layer.

Unfortunately, in the case when the deformation of the elastic member 102 is not controlled, the elastic member 102 enters between the mandrel 101 and the retaining member 103 as indicated by an arrow in FIG. 11B, when the elastic member 102 is deformed by the pressure exerted on the cone 105. This allows the elastic member 102 having entered between the mandrel 101 and the retaining member 103 to constrict or extend the mandrel 101. As a result, deformation may occur in the mandrel 101, or a breakage may be caused to other components (not illustrated) constituting the downhole plug.

Note that the retaining member 103 described above is occasionally integrally formed with the cone 104. A downhole plug having such a configuration will be described below with reference to FIG. 12.

FIG. 12 is a view illustrating another aspect of a downhole plug in the related art, and schematically illustrating a portion of an axial cross-section of the downhole plug. Note that, for convenience of explanation, members having the same functions as those illustrated in FIG. 10 are denoted using the same reference signs, and descriptions of these will not be given.

As illustrated in FIG. 12, in a downhole plug 200, a retaining member 203 includes the retaining member 103 and the cone 104 illustrated in FIG. 10 integrally formed together. Even with the downhole plug 200 thus configured, an issue similar to that in the downhole plug 100 described above (see FIG. 10) arises.

The present invention has been made in view of the above-described issues, and aims to provide a plug for well completion, which does not cause an adverse effect such as failure of a member constituting the plug when a wellbore is plugged.

Solution to Problem

In order to resolve the above-described issues, a plug according to an aspect of the present invention is a plug configured to plug a wellbore provided at a well during completion, the plug comprising:

a tubular member having a hollow structure;

an elastic member with an annular shape attached to an outer circumferential surface of the tubular member, the annular elastic member being deformable by exerted pressure; and a retaining member with an annular shape attached, adjacent to the elastic member, onto the outer circumferential surface of the tubular member, downstream of where the pressure is exerted on the elastic member, wherein an inner circumferential edge of the retaining member, which comes in contact with the tubular member, protrudes toward the elastic member.

Another aspect of the present invention provides a retaining member used for a plug provided at a well during completion and having a function of plugging a wellbore. A retaining member according to another aspect of the present invention is a retaining member with an annular shape, used for a plug configured to plug a wellbore provided at a well during completion, the plug including a tubular member having a hollow structure; and an elastic member with an annular shape attached to an outer circumferential surface of the tubular member, the annular elastic member being deformable by exerted pressure, wherein the retaining member is attached, adjacent to the elastic member, onto the outer circumferential surface of the tubular member, downstream of where the pressure is exerted on the elastic member, and an inner circumferential edge of the retaining member which comes in contact with the tubular member protrudes toward a side which comes in contact with the elastic member.

Still another aspect of the present invention provides a method for well completion. The method for well completion according to the still another aspect of the present invention uses a plug according to an aspect of the present invention.

Advantageous Effects of Invention

According to an aspect of the present invention, a plug can be provided which does not cause an adverse effect such as failure of a member constituting the plug when a wellbore is plugged.

BRIEF DESCRIPTION OF THE DRAWINGS

FIG. 11A illustrates a view before exerting a pressure, and FIG. 11B illustrates a view after a pressure is exerted.

DESCRIPTION OF EMBODIMENTS

Embodiment 1

First, a downhole plug (plug) and a socket (retaining member) according to an embodiment of the present invention will be described below with reference to FIGS. 1 to 3.

Figure 1:
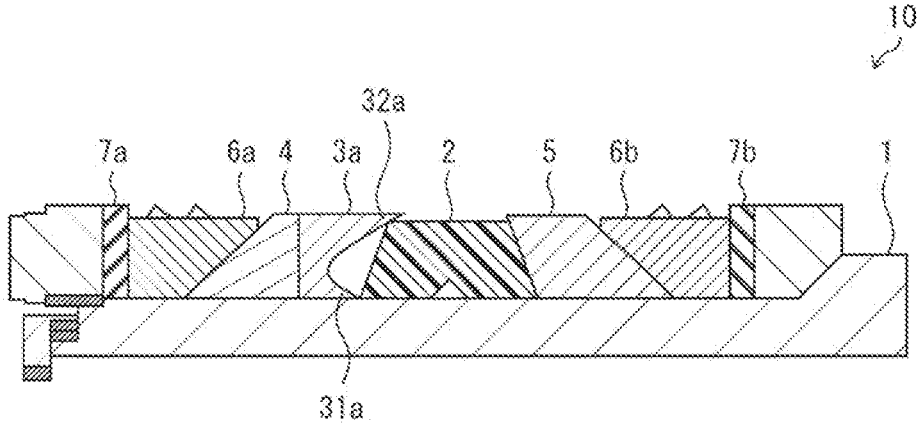
FIG. 1 is a view schematically illustrating a portion of an axial cross-section of a downhole plug according to Embodiment 1 of the present invention.

FIG. 1 is a view schematically illustrating a portion of an axial cross-section of the downhole plug according to the present embodiment. FIG. 2 is a view schematically illustrating an axial cross-section of another aspect of the downhole plug according to the present embodiment. FIG. 3 is a perspective cross-sectional view schematically illustrating the socket according to Embodiment 1. Note that, for convenience of explanation, in FIGS. 1 and 2, an axial direction of the downhole plug is illustrated as the horizontal direction of the plane of the paper. In an actual use, however, the downhole plug is occasionally disposed such that the axial direction of the downhole plug extends along the depth direction of a wellbore.

Referring to these figures, a downhole plug 10, which is a tool for well completion used for plugging a wellbore (not illustrated), includes a mandrel 1 (tubular member), a sealing member (elastic member) 2, a socket (retaining member) 3*a*, cones 4 and 5, a pair of slips 6*a* and 6*b*, and a pair of ring-shaped fixing members 7*a* and 7*b*.

The mandrel 1, which is a member for ensuring a strength of the downhole plug 10, has a hollow shape.

The sealing member 2, which is an annular rubber member, is attached onto an outer circumferential surface in an axial direction of the mandrel 1 between the socket 3*a* and the cone 5. The sealing member 2 is deformed when a pressure is exerted on the downhole plug 10. It is preferred that the sealing member 2 be formed from a material that does not lose a function of plugging a wellbore due to the sealing member 2 even in an environment under high temperature and high pressure, for example. Preferred materials for forming the sealing member 2 include nitrile rubber, hydrogenated nitrile rubber, acrylic rubber, and fluororubber. For the materials for forming the sealing member 2, a degradable rubber can also be used, such as aliphatic polyester-based rubber, polyurethane rubber, natural rubber, polyisoprene, acrylic rubber, aliphatic polyester rubber, polyester-based thermoplastic elastomer, or polyamide-based thermoplastic elastomer.

The socket 3*a* is an annular member attached, adjacent to the sealing member 2, onto the outer circumferential surface in the axial direction of the mandrel 1, downstream of where the pressure is exerted on the sealing member 2.

In the present embodiment, the socket 3*a* includes an inner circumferential edge 31*a* and an outer circumferential edge 32*a*. The inner circumferential edge 31*a* is in contact with the mandrel 1 and protrudes toward the sealing member 2. More specifically, a tip end of the protruding portion protrudes toward the sealing member 2 in a manner to come into contact with the mandrel 1. That is, a configuration is provided in which the entire of the inner circumferential surface of the socket 3*a*, including the protruding portion, is in contact with the mandrel 1.

On the other hand, the outer circumferential edge 32*a* protrudes toward the sealing member 2, and is in contact with the sealing member 2 at the inner side of the outer circumferential edge 32*a*. In the downhole plug 10, the height of protrusion at the outer circumferential edge 32*a* of the socket 3*a* is higher than the height of protrusion at the inner circumferential edge 31*a*. Note that the "height of protrusion" refers to a length in the axial direction of the mandrel.

The height of protrusion has no limitation as long as a desired advantage can be obtained. For example, in the downhole plug 10, the height of protrusion at the inner circumferential edge 32*a* of the socket 3*a* is 6.9 mm. Note that the advantage due to the protrusions of the inner circumferential edge 31*a* and the outer circumferential edge 32*a* of the socket 3*a* will be described later.

The cones 4 and 5 are formed such that when a load or pressure is exerted on the pair of slips 6*a* and 6*b* toward the sealing member 2, the slips 6*a* and 6*b* is slidably moved on an inclined surface of each of the cones 4 and 5.

The fixing members 7*a* and 7*b* are annular members that fix positions of the slips 6*a* and 6*b* with respect to the axial direction of the mandrel 1. The fixing members 7*a* and 7*b* are arranged adjacent to the slips 6*a* and 6*b* on the outer circumferential surface of the mandrel 1.

In the present embodiment, examples of the material that forms the mandrel 1, the socket 3*a*, the cones 4 and 5, the pair of slips 6*a* and 6*b*, and the pair of fixing members 7*a* and 7*b* include, for example, metal materials such as aluminum, steel, stainless steel, and the like; fibers; woods; composite materials; resins; and the like. The mandrel 1 can be composed of a composite material containing a reinforcing material such as carbon fiber, specifically, for example, a composite material containing a polymerized material such as epoxy resin and phenol resin, and the like. Further, it is preferred that the mandrel 1, the socket 3*a*, the cones 4 and 5, the pair of slips 6*a* and 6*b*, and the pair of fixing members 7*a* and 7*b* be each composed of a degradable resin or a degradable metal.

This facilitates removal of the downhole plug 10 after a wellbore processing is performed using the downhole plug 10.

Note that in this specification, the term "degradable resin or degradable metal" refers to resin or metal that can be biodegraded or hydrolyzed, dissolved in water or hydrocarbons within a well, and that can further be decomposed and embrittled to be easily disintegrated by some chemical method. Examples of the degradable resin include hydroxycarboxylic acid-based aliphatic polyesters such as polylactic acid (PLA) and polyglycolic acid (PGA); lactone-based aliphatic polyesters such as poly-ε-caprolactone (PCL); diol-dicarboxylic acid-based aliphatic polyesters such as polyethylene succinate and polybutylene succinate; copolymers of these, including, for example, poly(lactic-co-glycolic acid); as well as mixtures of these; and the like. Another example is an aliphatic polyester used by combining polyethylene adipate/terephthalate or similar aromatic components.

Further, examples of the water-soluble resin include polyvinyl alcohol; polyvinyl butyral; polyvinyl formal; polyacrylamide (optionally N,N-substituted); polyacrylic acid; and polymethacrylic acid. Another example is copolymers of monomers that form these resins, for example, ethylene-vinyl alcohol copolymers (EVOH), acrylamide-acrylic acid-methacrylic acid interpolymers, and the like.

Examples of the degradable metal include alloys containing magnesium, aluminum, calcium, and the like as main components, for example.

In the downhole plug 10, when a load is exerted on the slip 6*b* toward the sealing member 2, the slip 6*b* is slidably moved on an inclined surface of the cone 5 to cause the sealing member 2 to be deformed. Then, the sealing member 2 plugs the wellbore.

In the downhole plug 10, when the sealing member 2 is deformed by an axially-oriented pressure exerted inside a well, the socket 3*a* attached downstream of the pressure receives the deformation of the sealing member 2. Here, the inner circumferential edge 31*a* of the socket 3*a* that is in contact with the mandrel 1 has a shape protruding toward the sealing member 2 as described above. This effectively prevents a portion of the sealing member 2 having been deformed by a pressure exerted in a direction toward the socket 3*a* from entering between the socket 3*a* and the mandrel 1.

Accordingly, the downhole plug 10 prevents deformation or breakage of components such as the mandrel 1 of the downhole plug 10 from occurring, due to the sealing member 2 entering between the socket 3*a* and the mandrel 1.

Moreover, according to the downhole plug 10, the outer circumferential edge 32*a* of the socket 3*a* protrudes toward the sealing member 2, and the socket 3*a* is in contact with the sealing member 2 at the inner side of the outer circumferential edge 32*a*. Thus, according to the downhole plug 10, the sealing member 2 is deformed by a pressure exerted inside the wellbore, making it possible to prevent the sealing member 2 from flowing from the outer circumferential edge 32*a* of the socket 3*a* to the outside of the downhole plug 10. This makes it possible to prevent plugging of the wellbore in a more reliable manner.

Figure 2:
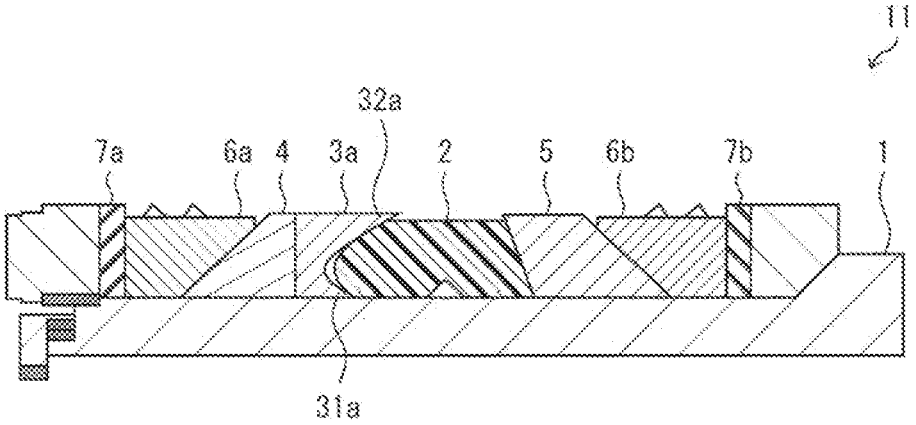
FIG. 2 is a view schematically illustrating a portion of an axial cross-section of another aspect of a downhole plug according to Embodiment 1 of the present invention.
Figure 3:
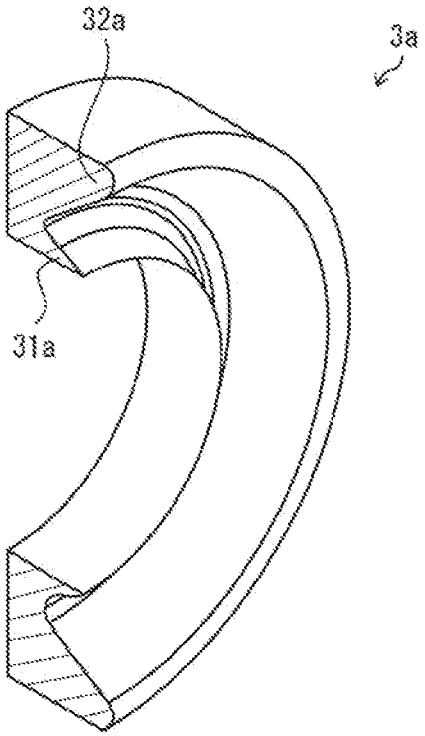
FIG. 3 is a perspective cross-sectional view schematically illustrating a socket according to Embodiment 1 of the present invention.

Note that, as another aspect of the downhole plug, a configuration of the downhole plug 11 illustrated in FIG. 2 may be employed as well. That is, as illustrated in FIG. 2, a side of the sealing member 2 that comes in contact with the socket 3*a* may enter into a concave portion between the inner circumferential edge 31*a* and the outer circumferential edge 32*a* formed by the protrusions of the inner circumferential edge 31*a* and the outer circumferential edge 32*a* of the socket 3*a*.

Such a configuration in which the sealing member 2 enters into the concave portion allows, when the sealing member 2 is deformed due to a load inside the wellbore, the sealing member 2 to be pressed against the socket 3*a* with less load, causing deformation of the sealing member 2. Accordingly, the wellbore can be plugged with less load.

When the side of the sealing member 2 that is in contact with the socket 3*a* enters into the concave portion of the socket 3*a*, the shape of the side of the sealing member 2 that is in contact with the socket 3*a* may match the shape of the concave portion, or may be shaped to create a gap in the concave portion without completely matching the shape of the concave portion.

As still another aspect, the socket may be provided to come in contact with the sealing member 2 even upstream of where the pressure is exerted. That is, a configuration may be employed in which a socket is also provided between the cone 5 and the sealing member 2, and the sealing member 2 is clamped between the two sockets.

Embodiment 2

Another embodiment of the downhole plug and socket according to an aspect of the present invention will be described below with reference to FIGS. 4 and 5. Note that, for convenience of explanation, members having the same functions as those used in the above-described embodiment are denoted by the same reference signs, and descriptions of these will not be given.

Figure 4:
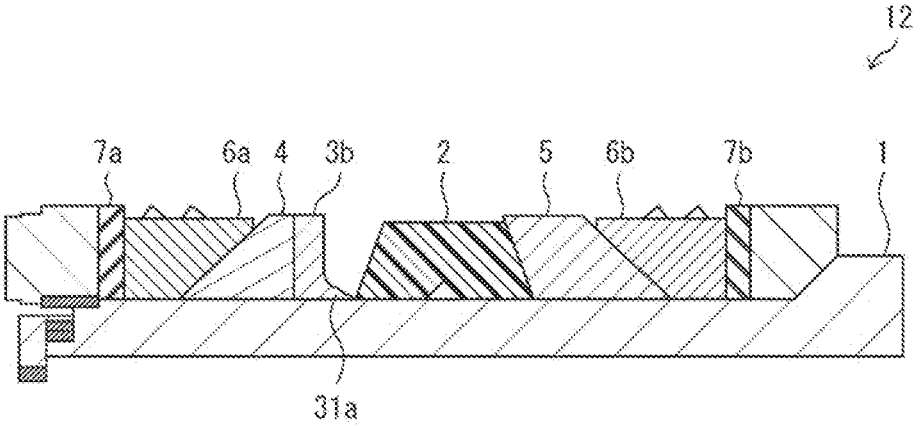
FIG. 4 is a view schematically illustrating a portion of an axial cross-section of a downhole plug according to Embodiment 2 of the present invention.
Figure 5:
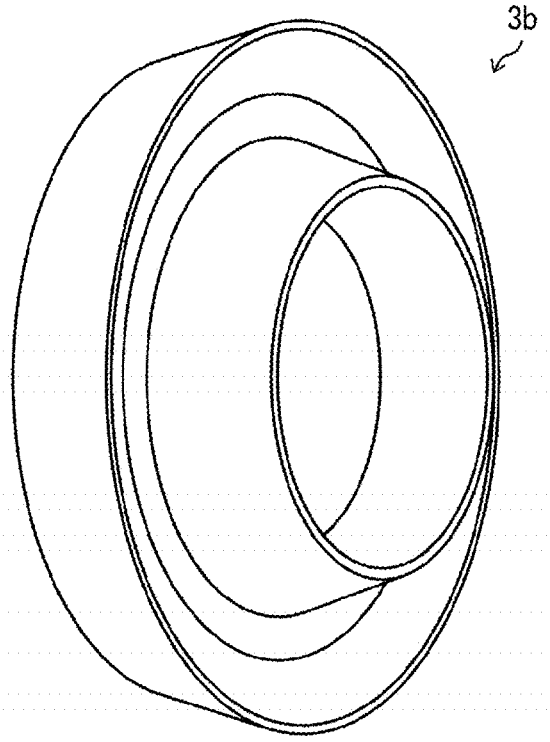
FIG. 5 is a perspective view schematically illustrating a socket illustrated in FIG. 4.

FIG. 4 is a view schematically illustrating a portion of an axial cross-section of a downhole plug according to the present embodiment. FIG. 5 is a perspective view schematically illustrating a socket illustrated in FIG. 4. Note that, for convenience of explanation, in FIG. 4, an axial direction of the downhole plug is illustrated as the horizontal direction of the plane of the paper. In an actual use, however, the downhole plug is occasionally disposed such that the axial direction of the downhole plug extends along the depth direction of a wellbore.

Referring to these figures, in a downhole plug 12 according to the present embodiment, a socket 3*b* has a shape that the inner circumferential edge 31*a* protrudes toward the sealing member 2, as in the socket 3*a*. On the other hand, the outer circumferential edge of the socket 3*b* does not protrude toward the sealing member 2. The socket 3*b*, which also has a shape that the inner circumferential edge 31*a* protrudes toward the sealing member 2, can prevent a portion of the sealing member 2 having been deformed by a pressure exerted in a direction toward the socket 3*b* from entering between the socket 3*b* and the mandrel 1.

Embodiment 3

Still another embodiment of the downhole plug and socket according to an aspect of the present invention will be described below based on FIGS. 6 and 7. Note that, for convenience of explanation, members having the same functions as those used in the above-described embodiments are denoted by the same reference signs, and descriptions of these will not be given.

Figure 6:
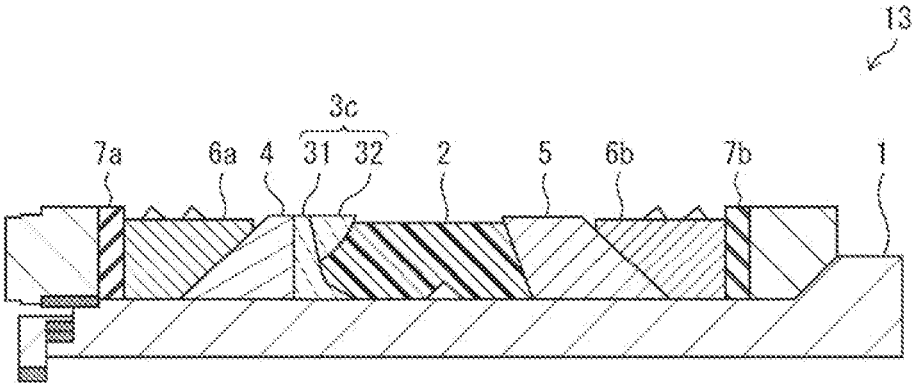
FIG. 6 is a view schematically illustrating a portion of an axial cross-section of a downhole plug according to Embodiment 3 of the present invention.
Figure 7:
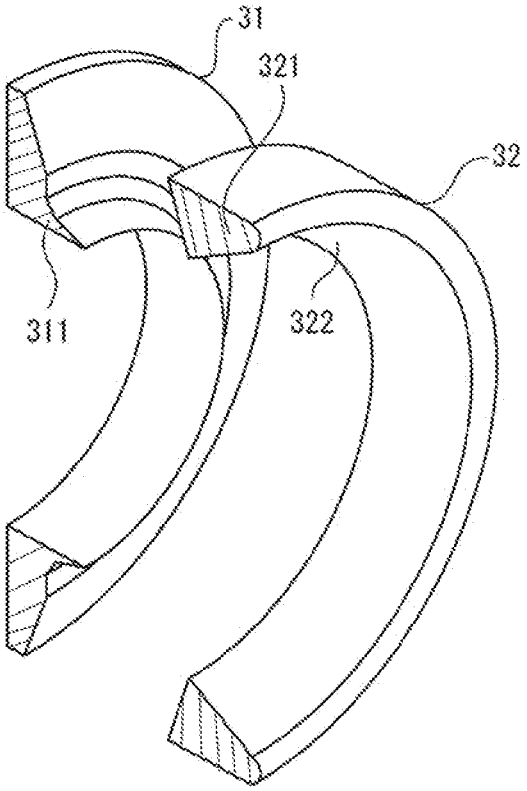
FIG. 7 is a perspective exploded cross-sectional view schematically illustrating a socket illustrated in FIG. 6.

FIG. 6 is a view schematically illustrating a portion of an axial cross-section of a downhole plug according to the present embodiment. FIG. 7 is a perspective exploded cross-sectional view schematically illustrating a socket illustrated in FIG. 6. Note that, for convenience of explanation, in FIG. 6, an axial direction of the downhole plug is illustrated as the horizontal direction of the plane of the paper. In an actual use, however, the downhole plug is occasionally disposed such that the axial direction of the downhole plug extends along the depth direction of a wellbore.

Referring to these figures, in a downhole plug 13 according to the present embodiment, a socket 3*c* is configured to include a socket-inner 31 (inner portion) in an annular shape including an inner circumferential edge 311, which is in contact with the outer circumferential surface of the mandrel 1, and a socket-outer 32 (outer portion) having an inner diameter larger than that of the socket-inner 31 and movably attached to the socket-inner 31.

The socket-outer 32 includes an outer circumferential edge 321 serving as the outer circumferential edge of the socket 3*c*, and includes a face 322 facing the sealing member 2.

According to the downhole plug 13, the sealing member 2 is deformed by a pressure exerted inside the wellbore (not illustrated), to cause the socket-outer 32 to be deformed such that a diameter of the socket-outer 32 is extended when the sealing member 2 is pressed against the socket 3*c*. In accordance with the above, the socket-outer 32 is moved relative to the socket-inner 31 to change a form of the socket 3*c*. This allows a force exerted on the socket 3*c* from the sealing member 2 to disperse, making it possible to prevent breakage and deformation of members such as the socket 3*c*, which constitute the downhole plug 13 and the like.

In view of the above, it is preferred that the socket-outer 32 contain a material that can change to extend in diameter when a pressure is exerted on the socket-outer 32 from the sealing member 2. In the present embodiment, the socket-outer 32 is composed of PGA.

Note that, in the downhole plug 13, the side of the sealing member 2 that is in contact with the socket 3*a* enters into the concave portion of the socket 3*c*, as in the downhole plug 11 described above. More specifically, the shape of the side of the sealing member 2 that is in contact with the socket 3*c* has a shape that approximately matches the shape of the concave portion.

In the present embodiment, the configuration of the downhole plug is, but not limited to, the configuration of the downhole plug 13 described above. Accordingly, in the downhole plug according to the present embodiment, a non-illustrated socket-outer may have an inner diameter commensurate with that of the socket-inner, and may be movably attached to the socket-inner.

The downhole plug according to the present embodiment may further be implemented as a first or second alternative aspect that will be described below.

First Alternative Aspect

In a first alternative aspect of the downhole plug according to the present embodiment, the socket-inner 31 and the cone 4 in the downhole plug 13 illustrated in FIG. 6 may be integrally formed together. The downhole plug having such a configuration will be described below with reference to FIG. 8.

Figure 8:
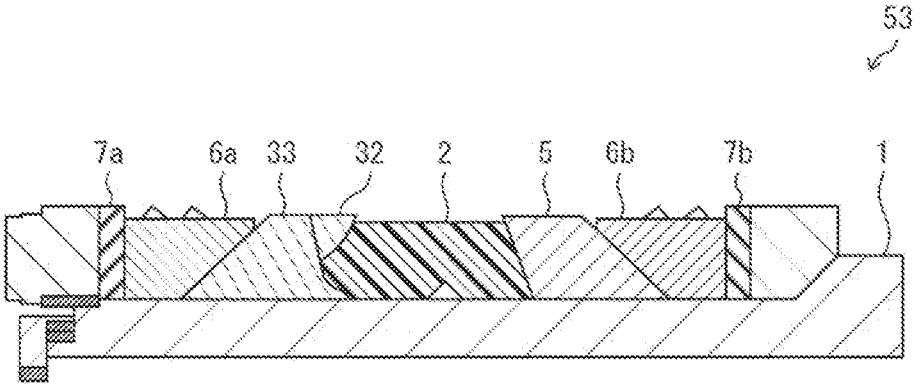
FIG. 8 is a view schematically illustrating a portion of an axial cross-section of a downhole plug according to a first alternative aspect of the present invention.

FIG. 8 is a view schematically illustrating a portion of an axial cross-section of a downhole plug according to a first alternative aspect. For convenience of explanation, in FIG. 8, an axial direction of the downhole plug is illustrated as the horizontal direction of the plane of the paper. In an actual use, however, the downhole plug is occasionally disposed such that the axial direction of the downhole plug extends along the depth direction of a wellbore. Note that, for convenience of explanation, members having the same function as those illustrated in FIG. 6 are denoted by the same reference signs, and descriptions of these will not be given.

As illustrated in FIG. 8, in a downhole plug 53, a socket-inner 33 is formed as an integrated component that the socket-inner 31 and the cone 4 illustrated in FIG. 6 are integrally formed together, as described above. That is, a configuration is employed in which the cone also serves as a socket, specifically, a socket-inner. Thus, a structure on the side of the sealing member 2 of the inner circumferential edge of the cone includes the structure on the side of the sealing member 2 of the inner circumferential edge of the above-described socket. As the downhole plug 53 thus configured, the same advantage is obtained as in the downhole plug 13 (see FIG. 6).

Second Alternative Aspect

In a second alternative aspect of the downhole plug according to the present embodiment, the inner diameter of the socket-outer may be the same as the inner diameter of the socket-inner. A downhole plug having such a configuration will be described below with reference to FIG. 9.

Figure 9:
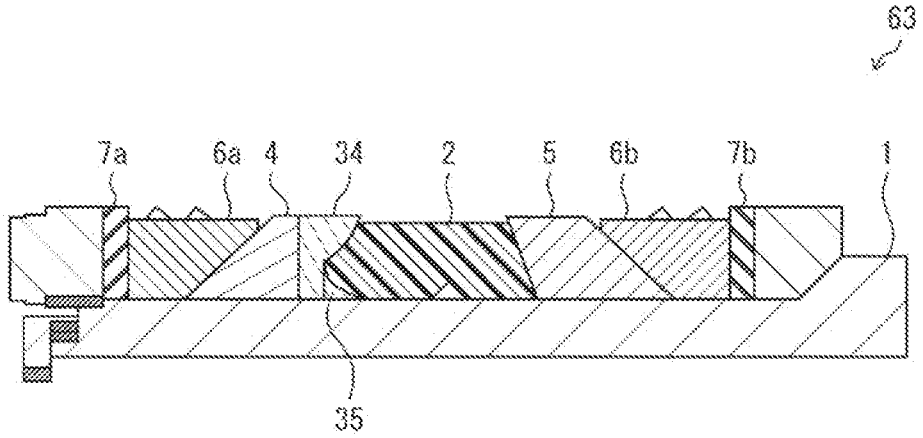
FIG. 9 is a view schematically illustrating a portion of an axial cross-section of a downhole plug according to a second alternative aspect of the present invention.

FIG. 9 is a view schematically illustrating a portion of an axial cross-section of a downhole plug according to a second alternative aspect. For convenience of explanation, in FIG. 9, an axial direction of the downhole plug is illustrated as the horizontal direction of the plane of the paper. In an actual use, however, the downhole plug is occasionally disposed such that the axial direction of the downhole plug extends along the depth direction of a wellbore. Note that, for convenience of explanation, members having the same function as those illustrated in FIG. 6 are denoted by the same reference signs, and descriptions of these will not be given.

As illustrated in FIG. 9, in a downhole plug 63, the inner diameter of a socket-outer 34 is the same as the inner diameter of a socket-inner 35. The socket-outer 34 has the outer diameter larger than the socket-inner 35, and the socket-inner 35 is disposed at a position at which the socket-inner 35 is clamped between the socket 34 and the sealing member 2. As the downhole plug 63 thus configured, the same advantage is obtained as in the downhole plug 13.

Note that, in the downhole plug of the second alternative aspect, the socket-outer may be integrally formed with a cone. That is, a configuration may be employed in which the cone also serves as a socket, specifically, a socket-outer.

Embodiment 4

The method for well completion according to an embodiment of the present invention performs well completion using any of the downhole plugs 10 to 13 described in the embodiments 1 to 3 described above. The above method can be similar to the method of well completion in the related art using a downhole plug except for using the downhole plugs 10 to 13 as a downhole plug.

According to Embodiment 4, when a wellbore is plugged by the sealing member 2, a deformation of the sealing member 2 does not cause an adverse effect such as a breakage on members constituting the downhole plug. Thus, a well completion can be performed in an efficient manner.

SUMMARY

In order to resolve the above-described issues, a plug according to an aspect of the present invention is a plug configured to plug a wellbore provided at a well during completion, the plug comprising:

a tubular member having a hollow structure;

an elastic member with an annular shape attached to an outer circumferential surface of the tubular member, the annular elastic member being deformable by exerted pressure; and a retaining member with an annular shape attached, adjacent to the elastic member, onto the outer circumferential surface of the tubular member, downstream of where the pressure is exerted on the elastic member, wherein an inner circumferential edge of the retaining member, which comes in contact with the tubular member, protrudes toward the elastic member.

According to the above-described configuration, an elastic member and a retaining member adjacent to the elastic member are provided at the outer circumferential surface of the tubular member having a hollow structure. The retaining member is located downstream of where the pressure is exerted on the elastic member. Thus, when the elastic member is deformed by a pressure exerted inside the wellbore, the retaining member attached downstream of the pressure is to receive the deformation.

Here, the inner circumferential edge of the retaining member that is in contact with the tubular member has a shape protruding toward the elastic member. The inner circumferential edge of the retaining member, which has the above-described shape, makes it possible to prevent some of the elastic members having been deformed by a pressure exerted in a direction toward the retaining member from entering between the retaining member and the tubular member. This prevents deformation or breakage of the tubular member from occurring, due to the elastic member entering between the retaining member and the tubular member. Further, in the plug according to an embodiment of the present invention, preferably an outer circumferential edge of the retaining member protrudes toward the elastic member to come in contact with the elastic member at an inner side of the outer circumferential edge.

According to the above-described configuration, the elastic member is deformed by a pressure exerted inside the wellbore, making it possible to prevent the elastic member from flowing from the outer circumferential edge of the retaining member to the outside of the plug. This makes it possible to prevent plugging of the wellbore in a more reliable manner.

Further, in the plug according to an embodiment of the present invention, preferably a side of the elastic member, which is in contact with the retaining member, enters into a concave portion between the inner circumferential edge and the outer circumferential edge formed by protrusions of the inner circumferential edge and the outer circumferential edge of the retaining member.

According to the above-described configuration, when the elastic member is deformed as a gap between the cone and the retaining member is narrowed inside the wellbore, the elastic member can be pressed against the retaining member with less load. Accordingly, the wellbore can be plugged with less load. Further, in the plug according to an embodiment of the present invention, preferably the retaining member is composed of a degradable resin or a degradable metal.

According to the above-described configuration, the retaining member can be degraded after the plug is used, making it possible to dispense with the time and effort necessary for collecting the retaining member after the plug is used.

In the plug according to an embodiment of the present invention, preferably, the retaining member is configured to include an inner portion in an annular shape including the inner circumferential edge, which is in contact with the outer circumferential surface of the tubular member, and an outer portion in an annular shape having an inner diameter equivalent to or larger than an inner diameter of the inner portion and movably attached to the inner portion, wherein the outer portion includes a face facing the elastic member.

According to the above-described configuration, the elastic member is deformed by a pressure exerted inside the wellbore, to cause the outer portion to move and change a form of the retaining member when the elastic member is pressed against the retaining member. This allows a force exerted on the retaining member from the elastic member to disperse, making it possible to prevent breakage to the retaining member. Further, the outer portion can retain the elastic member to prevent the elastic member from flowing to the outside of the plug. This makes it possible to prevent plugging of the wellbore in a more reliable manner.

Another aspect of the present invention provides a retaining member used for a plug provided at a well during completion and having a function of plugging a wellbore. A retaining member according to another aspect of the present invention is a retaining member with an annular shape, used for a plug configured to plug a wellbore provided at a well during completion, the plug including a tubular member having a hollow structure; and an elastic member with an annular shape attached to an outer circumferential surface of the tubular member, the annular elastic member being deformable by exerted pressure, wherein the retaining member is attached, adjacent to the elastic member, onto the outer circumferential surface of the tubular member, downstream of where the pressure is exerted on the elastic member, and an inner circumferential edge of the retaining member which comes in contact with the tubular member protrudes toward a side which comes in contact with the elastic member.

Still another aspect of the present invention provides a method for well completion. The method for well completion according to the still another aspect of the present invention uses a plug according to an aspect of the present invention.

The present invention is not limited to the embodiments described above, and may be variously altered within the scope set forth in the claims. That is, embodiments obtained by combining appropriately altered technical means within the scope set forth in the claims are encompassed within the technical scope of the present invention.

EXAMPLES

In order to investigate a technical advantage of the downhole plug according to another aspect of the present invention, the following experiments were conducted.

Example 1

Formation of Downhole Plug (A)

A downhole plug (A) having a configuration described in Embodiment 1 was prepared as a downhole plug of Example 1. Note that the mandrel, socket, and cone were formed from PGA, the pair of slips, and the pair of ring-shaped fixing members were formed from magnesium alloy, and the sealing member was formed from polyurethane rubber.

Evaluation of Water-Pressure Test Results

The downhole plug (A) was fixed in a casing by performing an actuation. Next, water was sealed within the casing while heating the inside of the casing to a temperature of 93° C., then water pressure of 10000 psi (approximately 70 MPa) was exerted on the downhole plug (A) with a pump to examine whether the downhole plug (A) can retain the water pressure for not less than 30 minutes. Then, if the downhole plug (A) could retain the water pressure for not less than 30 minutes, an evaluation of "Pass" is given as acceptable, while if the downhole plug (A) could not retain the water pressure for not less than 30 minutes, an evaluation of "Fail" is given as not acceptable. The results are listed in Table 1.

Example 2

Formation of Downhole Plug (B)

A downhole plug (B) having a configuration described in Embodiment 3 was prepared as a downhole plug of Example 2. Note that the mandrel, socket, and cone were formed from PGA, the pair of slips, and the pair of ring-shaped fixing members were formed from magnesium alloy, and the sealing member was formed from polyurethane rubber. The water-pressure test results were then evaluated by the same procedure as in Example 1. The results are listed in Table 1.

Comparative Example 1

Figure 10:
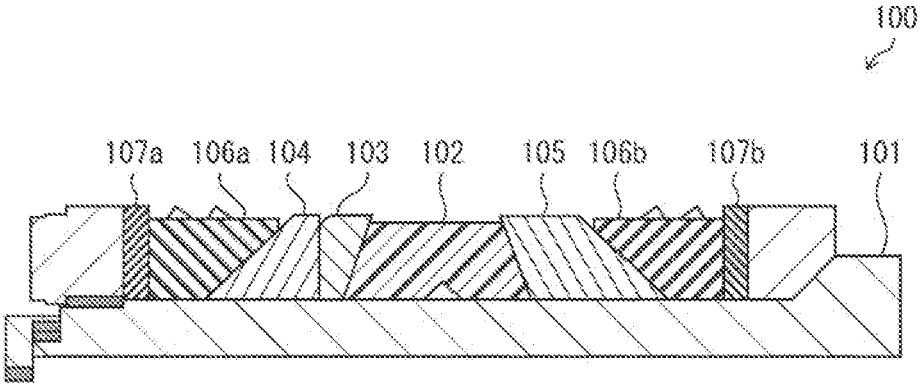
FIG. 10 is a view schematically illustrating a portion of an axial cross-section of a downhole plug in the related art.
Figure 11A:
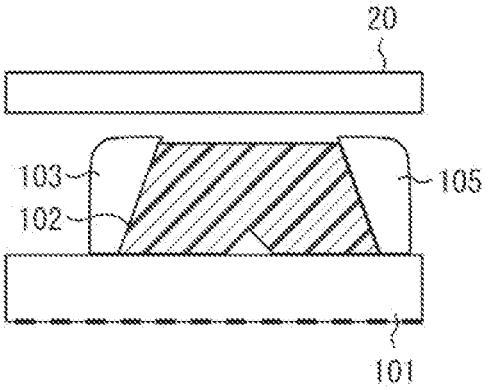
FIGS. 11A and 11B are views schematically illustrating a portion of a downhole plug illustrated in FIG. 10, where
Figure 11B:
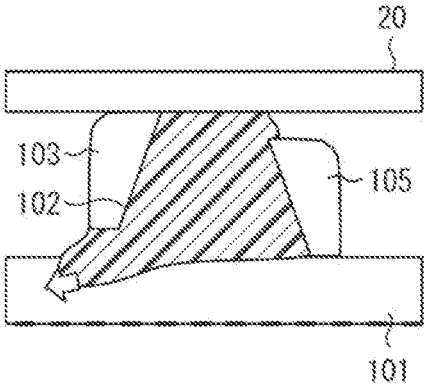
Figure 12:
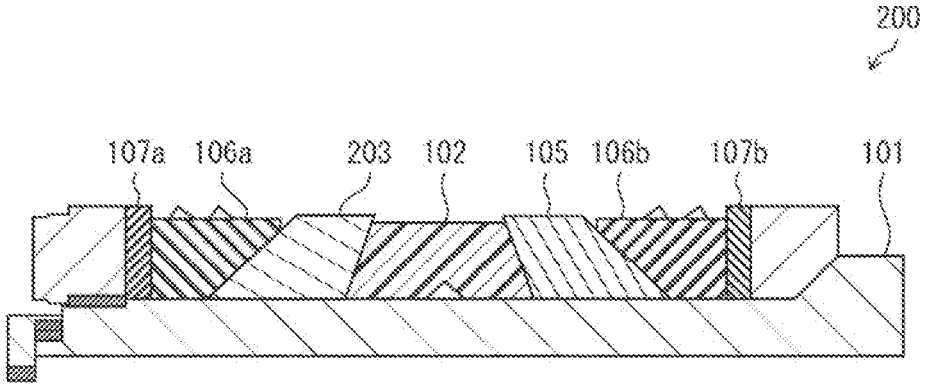
FIG. 12 is a view of another aspect of a downhole plug in the related art, schematically illustrating a portion of an axial cross-section of the downhole plug.

A downhole plug (C) was prepared as a downhole plug of Comparative Example 1, where the downhole plug (C) has a configuration as in the downhole plug (A) except for using a socket in which the inner circumferential edge of the socket does not protrude toward the sealing member as illustrated in FIG. 10. The water-pressure test results were then evaluated by the same procedure as in Example 1. The results are listed in Table 1.

TABLE 1

| | Actuation Load (kN) | Water-pressure test |
|---|---|---|
| Example 1 | 162 | Pass |
| Example 2 | 66 | Pass |
| Comparative Example 1 | 98 | Fail |

The downhole plugs of Example 1 and Example 2 could retain a sealed state under water pressure of 10000 psi for not less than 30 minutes. The downhole plug was disassembled to confirm that the flowing of the sealing member to the inside of the socket had been suppressed, and it was confirmed that breakage of the mandrel had been suppressed.

On the other hand, in the downhole plug of Comparative Example 1, the seal sate could not be retained under water pressure of 10000 psi for not less than 30 minutes. The downhole plug was disassembled to confirm that the sealing member had flown to the inside of the socket, to thus fasten the mandrel to cause breakage of the mandrel.

In addition, the downhole plug of Example 2, which has the shape of the sealing member, on a side in contact with the socket, coinciding with the concave portion of the socket, could seal the inside of the casing with less actuation load.

INDUSTRIAL APPLICABILITY

The present invention can be used as a plug having a function of plugging a wellbore provided at a well during completion.

REFERENCE SIGNS LIST

1 Mandrel (Tubular member)
2 Sealing member (Elastic member)
3 Socket (Retaining member)
4, 5 Cone
6*a*, 6*b* Slip
7*a*, 7*b* Ring-shaped fixing member
10, 11, 12, 13 Downhole plug (Plug)
31 Socket-inner
32 Socket-outer

The invention claimed is:

1. A plug configured to plug a wellbore provided at a well during completion, the plug comprising:

a tubular member having a hollow structure;

an elastic member attached to an outer circumferential surface of the tubular member;

a retaining member attached to the outer circumferential surface of the tubular member and in contact with a first side of the elastic member, the retaining member including inner circumferential edge contacting the tubular member and protruding toward the elastic member;

a first cone attached to the outer circumferential surface of the tubular member and in contact with a second side of the elastic member opposite to the first side of the elastic member in contact with the retaining member; and a second cone attached to the outer circumferential surface of the tubular member and in contact with the retaining member;

wherein the elastic member deforms when a pressure exerted toward an axial direction of the plug, and wherein the deformation of the elastic member is received by the retaining member and the protrusion of the inner circumferential edge of the retaining member prevents the elastic member from entering between the retaining member and the tubular member.

2. The plug according to claim 1, wherein the retaining member further includes an outer circumferential edge radially spaced from the inner circumferential edge and protruding towards the elastic member, and the elastic member contacts an inner side of the outer circumferential edge of the retaining member.

3. The plug according to claim 2, wherein the retaining member includes a concave portion between the inner circumferential edge and the outer circumferential edge; the concave portion including the inner side of the outer circumferential edge of the retaining member; and the first side of the elastic member is disposed in the concave portion of the retaining member.

4. The plug according to claim 1, wherein the retaining member is composed of a degradable resin or a degradable metal.

5. The plug according to claim 1, wherein the retaining member includes:

an inner portion including the inner circumferential edge, and an outer portion having an inner diameter equivalent to or larger than an inner diameter of the inner portion and movably attached to the inner portion, the outer portion including a face facing the elastic member.

6. A method for well completion, comprising:

sealing a well with the plug according to claim 1.

7. A plug configured to plug a wellbore provided at a well during completion, the plug comprising:

a tubular member having a hollow structure;

an elastic member attached to an outer circumferential surface of the tubular member; and a retaining member attached to the outer circumferential surface of the tubular member and in contact with a first side of the elastic member, the retaining member including inner circumferential edge contacting the tubular member and protruding toward the elastic member;

wherein the elastic member deforms when a pressure exerted toward an axial direction of the plug, wherein the deformation of the elastic member is received by the retaining member and the protrusion of the inner circumferential edge of the retaining member prevents the elastic member from entering between the retaining member and the tubular member, and wherein the plug has a gap between the second side of the elastic member and the retaining member, when the pressure is not exerted on the plug.

8. The plug according to claim 2, wherein the protrusion of the outer circumferential edge has a larger height than that of the inner circumferential edge.

* * * * *